United States Patent [19]

Campbell

[11] 4,092,562

[45] May 30, 1978

[54] FLUORESCENT LAMP UNIT FOR MULTIPLE INSTALLATION

[75] Inventor: John H. Campbell, Mentor, Ohio

[73] Assignee: General Electric Company, Schenectady, N.Y.

[21] Appl. No.: 684,072

[22] Filed: May 7, 1976

Related U.S. Application Data

[63] Continuation of Ser. No. 599,521, Jul. 28, 1975, abandoned.

[51] Int. Cl.[2] ..... H05B 41/16

[52] U.S. Cl. ..... 315/189; 313/318; 315/59; 315/95; 315/113; 315/324; 315/DIG. 5; 339/57; 339/144 R; 362/221

[58] Field of Search ..... 315/36, 50, 58, 59, 315/71, 95–97, 100, 185 R, 189, 112, 113, 250, 312, 324, DIG. 5; 240/9 R, 51.11 R; 339/52 R, 57, 144 R; 313/318

[56] References Cited

U.S. PATENT DOCUMENTS

| | | | |
|---|---|---|---|
| 2,056,635 | 10/1936 | Wiegand | 315/58 |
| 2,087,759 | 7/1937 | Gaidies | 315/58 |
| 2,160,786 | 5/1939 | Peterson | 313/318 |
| 2,273,960 | 2/1942 | Hopkin | 313/491 |
| 2,344,160 | 3/1944 | Meese et al. | 240/31 |
| 2,344,935 | 3/1944 | Whittaker | 240/9 |
| 2,408,471 | 10/1946 | Merrill | 339/57 X |
| 2,581,546 | 1/1952 | Mann | 315/100 |
| 2,652,483 | 9/1953 | Laidig et al. | 240/51.12 |
| 2,814,787 | 11/1957 | Jessup | 339/52 |
| 3,564,234 | 2/1971 | Phlieger, Jr. | 240/51.11 R |
| 3,714,492 | 1/1973 | Roche | 315/105 X |
| 3,753,036 | 8/1973 | Roche | 315/60 |

FOREIGN PATENT DOCUMENTS

| | | | |
|---|---|---|---|
| 111,596 | 3/1962 | Pakistan | 315/58 |

*Primary Examiner*—Eugene R. LaRoche
*Attorney, Agent, or Firm*—Norman C. Fulmer; Lawrence R. Kempton; Frank L. Neuhauser

[57] ABSTRACT

A compact integral permanently assembled lamp unit comprising a fluorescent lamp, resistor ballast, starter means, and end connectors for connecting a plurality of lamps together.

23 Claims, 6 Drawing Figures

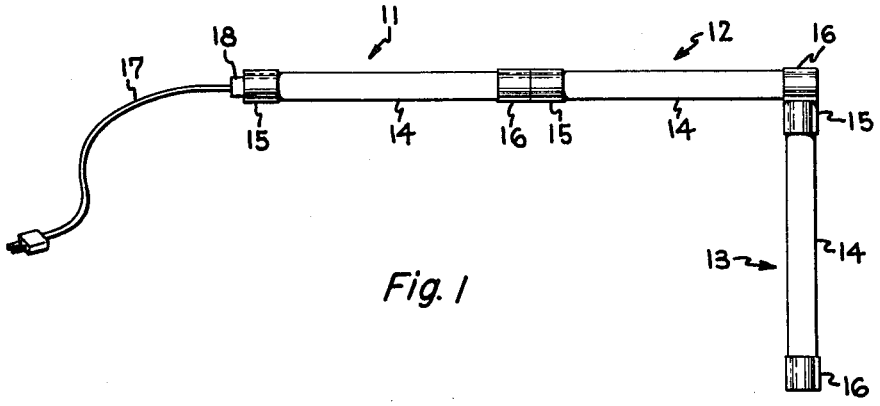
Fig. 1
Fig. 2
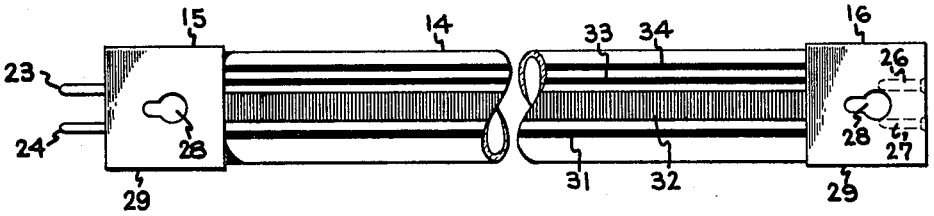
Fig. 3
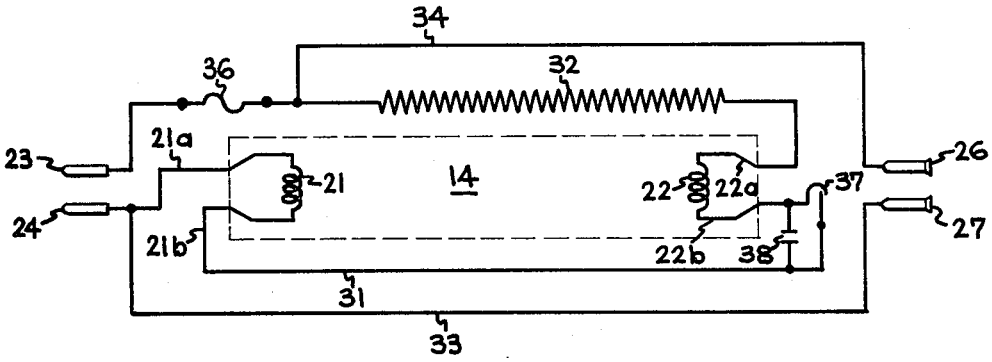

FLUORESCENT LAMP UNIT FOR MULTIPLE INSTALLATION

This is a continuation of application Ser. No. 599,521, filed July 28, 1975, now abandoned.

CROSS-REFERENCES TO RELATED APPLICATIONS

Ser. No. 599,523, Elmer G. Fridrich, filed July 28, 1975, "Fluorescent Lamp Unit," now U.S. Pat. No. 3,974,418 assigned the same as this invention.

Ser. No. 599,522, John M. Davenport and Elmer G. Fridrich, filed July 28, 1975, "Fluorescent Lamp Unit," now U.S. Pat. No. 3,996,493 and assigned the same as this invention.

BACKGROUND OF THE INVENTION

The invention is in the field of gas discharge lamps, such as fluorescent lamps, having an elongated bulb which usually is either straight or arcuate. The invention also is in the field of complete lamp units comprising a lamp, ballast means, and starting means.

There are numerous applications for elongated lamps, such as fluorescent lamps, where it is desired to arrange a plurality of lamps close together, such as in a long straight line configuration, and/or angled or curved configurations. Such configurations are useful for lighting shelves, countertops, mirrors, etc. U.S. Pat. No. 2,344,935 to Whittaker describes an arrangement of elongated lamp fixtures, each comprising a channel member containing a starter and control unit and provided with a pair of spaced apart sockets, at the ends of the channel member, for receiving a replaceable fluorescent lamp. The two sockets are respectively provided with male and female connectors, so that one fixture can be plugged into another to form a straight line of fixtures. Also, angle-blocks are described for connecting the fixtures together at different angles. U.S. Pat. No. 2,652,483 to Laidig et al describes arrangements of semicircular fluorescent lamps connected together in various configurations by means of connector blocks. U.S. Pat. No. 2,814,787 to Jessup describes a connector socket for coupling together in series fluorescent lamps having filaments which have deteriorated so as to cease functioning.

SUMMARY OF THE INVENTION

Objects of the invention are to provide a convenient, compact, and slender elongated gas discharge lamp unit which can be connected to other lamp units to provide a multiple lamp installation.

The invention comprises, briefly and in a preferred embodiment, a compact integral permanently assembled lamp unit comprising an elongated gas discharge lamp containing electrodes therein near the ends thereof, first and second connector means permanently attached to first and second ends, respectively, of the discharge lamp, the first connector means being adapted to received operating electrical power for the lamp unit and the second connector means being adapted to supply operating electrical power to another lamp, an elongated resistor ballast arranged alongside the gas discharge lamp and connected to ballast the lamp when operating, starter means positioned in a housing of one of the connector means and connected to cause starting of the lamp, and electrical connections between said first and second connector means to supply operating electrical power at said second connector means for operating another lamp, said electrical connections and resistor ballast being positioned alongside the discharge lamp to function as a starting aid and to provide a slender configuration for the lamp unit.

BRIEF DESCRIPTION OF THE DRAWINGS

FIG. 1 is a view of a plurality of fluorescent lamps connected together in accordance with the invention.

FIG. 2 is a bottom view of a fluorescent lamp in accordance with the invention.

FIG. 3 is an electrical schematic diagram of an embodiment of the invention.

DESCRIPTION OF THE PREFERRED EMBODIMENTS

Figure 4:
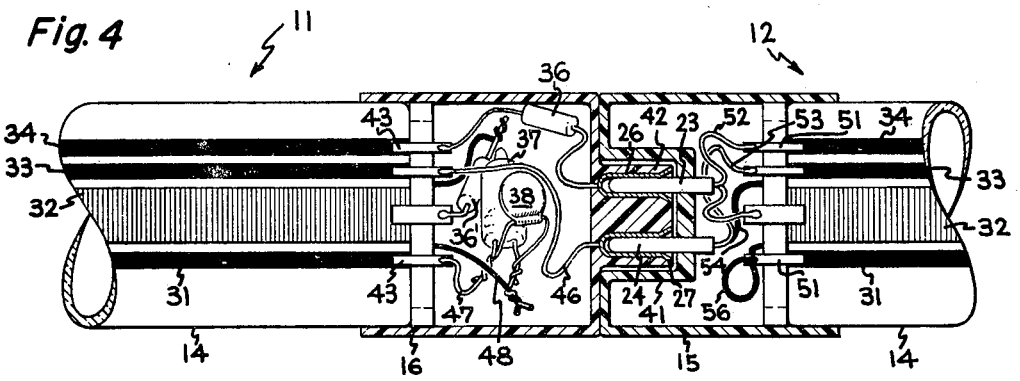
FIG. 4 is a bottom view, partly broken away, of two lamps connected together in accordance with the invention.

In FIG. 1, a plurality of lamp units 11, 12, and 13 are connected together end to end, the lamp units 11 and 12 being arranged in a straight line and the lamp unit 13 being at an angle with respect to lamp unit 12. Each of the lamp units 11, 12, and 13 comprises an elongated lamp 14, such as a fluorescent lamp, having permanently attached to the ends thereof an input power connector 15 and an output electrical power connector 16. An electrical power cord 17 is attached by means of a cord connector 18 to the input power connector 15 of the first lamp unit 11. Each of the lamps 14 is provided with a pair of electrodes 21 and 22 located respectively near the ends of the elongated lamp and connected across lead-in wires 21*a*, 21*b*, and 22*a*, 22*b*, as shown schematically in FIG. 3. Each lamp also is provided with means for providing a gaseous vapor, such as mercury vapor, in conventional manner.

As shown in FIG. 2, the power input connector 15 is provided with a pair of male electrical terminal prongs 23 and 24, and the power output connector 16 is provided with a pair of female electrical receptacles 26 and 27. Each of the power connectors 15 and 16 may be provided with a keyhole opening 28, for attaching the lamp unit at its connectors to a surface by means of screws, nails, or slotted studs. The surfaces 29 of the connectors to which the mounting means 28 is applied preferably is flat as more clearly shown in FIG. 5. The connectors 15 and 16 preferably comprise cupshaped hollow plastic members which are permanently attached to the ends of the lamp 14 by means of suitable adhesive.

Extending adjacent to and lengthwise alongside the lamp 14 are a starting conductor 31, a ballast resistor 32, and a pair of electrical power conductors 33, 34. Preferably, the elongated members 31–34 extend alongside the lamp 14 at a region thereof in alignment with and between the mounting surfaces 29 of the end connectors, so that they will be substantially unnoticed and will not substantially interfere with useful output light from the lamp 14. The elongated members 31–34 may be attached to the surface of the glass bulb of the lamp 14, such as by means of an adhesive, or by plating or otherwise forming them directly on the glass surface. Alternatively, the elongated members 31–34 may be carried on or in an elongated housing member, preferably of plastic material, extending alongside or attached to the lamp 14 such as by means of an adhesive material. It is preferred that the elongated members 31–34 be at or close to the lamp 14, preferably no farther than one-fourth of an inch, so as to aid in starting of the discharge in the lamp and also to provide a slender compact size of the unit.

As shown in FIG. 3, the input terminal 23 is electrically connected via a fuse 36 to an end of the ballast resistor 32, the other end of which is connected to an end of the electrode 22. The input terminal 23 is also electrically connected via the fuse 36 to an end of the electrical power conductor 34, the other end of which is electrically connected to the output terminal 26. Alternatively a fuse 36 of suitable rating can be connected in series with the conductor 33 or 34. The input terminal 24 is electrically connected to an end of the electrode 21, the other end of which is connected to an end of the starting conductor 31. The other end of the starting conductor 31 is connected to the remaining end of the electrode 22, via a starting switch 37 which may be a conventional well-known glow-starter switch, shunted by the usual capacitor 38. The input terminal 24 also is electrically connected to an end of the electrical power conductor 33, the other end of which is electrically connected to the output electrical terminal 27. The ballast resistor 32 may have a value of between 100 ohms to 200 ohms, for example, if the lamp 14 is a conventional 20-watt fluorescent lamp, and may be made in the form of a wire arranged in a zig-zag shape or wound around a flat support ribbon of suitable plastic material or in the form of a stripe of resistance material such as can be fired on the glass bulb or by metalic vapor deposition. The exact optimum value of resistance for the ballast 32 depends in part on the particular gas and fill pressure in the lamp 14, and must, of course, have sufficient wattage dissipation rating for the intended operating conditions.

The circuit of FIG. 3 operates in conventional well-known manner, as follows. When electrical power is applied to the input terminals 23, 24, the starter switch 37 closes, applying current through both electrodes 21 and 22 (which electrodes are coated with electron emissive material), via the ballast resistor 32, thereby heating the electrodes 21 and 22 to a temperature whereby they can emit electrons without destroying the emissive material. Thereupon, after a few seconds, the starter switch 37 opens, whereby an electrical discharge occurs in the lamp 14 between the electrodes 21 and 22, the electrode 21 now being connected to input terminal 24 and the electrode 22 being connected to input terminal 23 via the ballast resistor 32 which regulates the current flow to a safe and desired value. The same starting and operating procedure also occurs for subsequent lamps connected to the output terminals 26 and 27. The fuse 36 is for preventing overloading of the electrical input power circuit if more than a safe number of lamps are connected together in tandem. For example, twelve 20-watt lamp units connected in tandem would draw a total current of approximately four amperes from a 120-volt power source, and if this were deemed the maximum total safe number of such lamps to operate simultaneously from a single power outlet, the fuse 36 could be a 5-ampere fuse. If the circuit is overloaded by too many lamps being connected to it, only the fuse 36 in the first lamp unit (closest to the power source) would "blow", and the fuses in the remaining lamp units would be unaffected. The starting conductor 31, switch 37, and capacitor 38 can be omitted if the lamp 14 is an instant start type.

FIG. 4 shows details of the end connectors 15 and 16. For electrical safety, the end connector 15 is provided with a recess or well 41 in which the connector terminals 23 and 24 are positioned, and the end connector 16 is provided with a projection 42 in which the connector receptacles 26 and 27 are located. Metal tabs 43 are soldered or otherwise electrically connected to the starting conductor 31, the ballast resistor 32, and the power conductors 33 and 34, at the end of the lamp 14 which is attached to the end connector 16. Within the hollow end connector 16, the fuse 36 is electrically connected between the tab 43 of conductor 34, and the receptacle 26; a wire 46 is electrically connected between the tab 43 of conductor 33 and the receptacle 27; an individual lamp fuse 36' is electrically connected between the tab 43 of the ballast resistor 32, and a lead-in wire for the lamp electrode 22; and the tab 43 of conductor 31 is connected electrically by a wire 47 to the starting device 37, the other terminal of which is connected by wiring 48 to the remaining lead-in wire of the lamp electrode 22.

Metal tabs 51 are soldered or otherwise electrically connected to the starting conductor 31, the ballast resistor 32, and the power conductors 33, 34 at the end of the lamp 14 which is attached to the input power connector 15. A wire 52 is electrically connected from the tab 51 which is attached to the power conductor 34, to the connector terminal 23, and also to the tab on the resistor 32; a wire 53 is electrically connected between the tab 51 at the power conductor 33, and the connector terminal 24 and also is electrically connected to a lead-in wire 54 of the lamp electrode 21; and the lead-in wire 56 for the lamp electrode 21 is connected to tab 51 at the starting conductor 31. Since the connector projection 42 fits into the connector recess 41 when lamps are being plugged or unplugged into or from each other, and since the terminals 23 and 24 do not project beyond the end surface of the connector member 15, it is impossible for an object to come into contact with the terminals 23 or 24 and cause shorting of these terminals, or electrical shock to a person, when these terminals are electrically energized by being in contact with the receptacle members 26,27.

Figure 5:
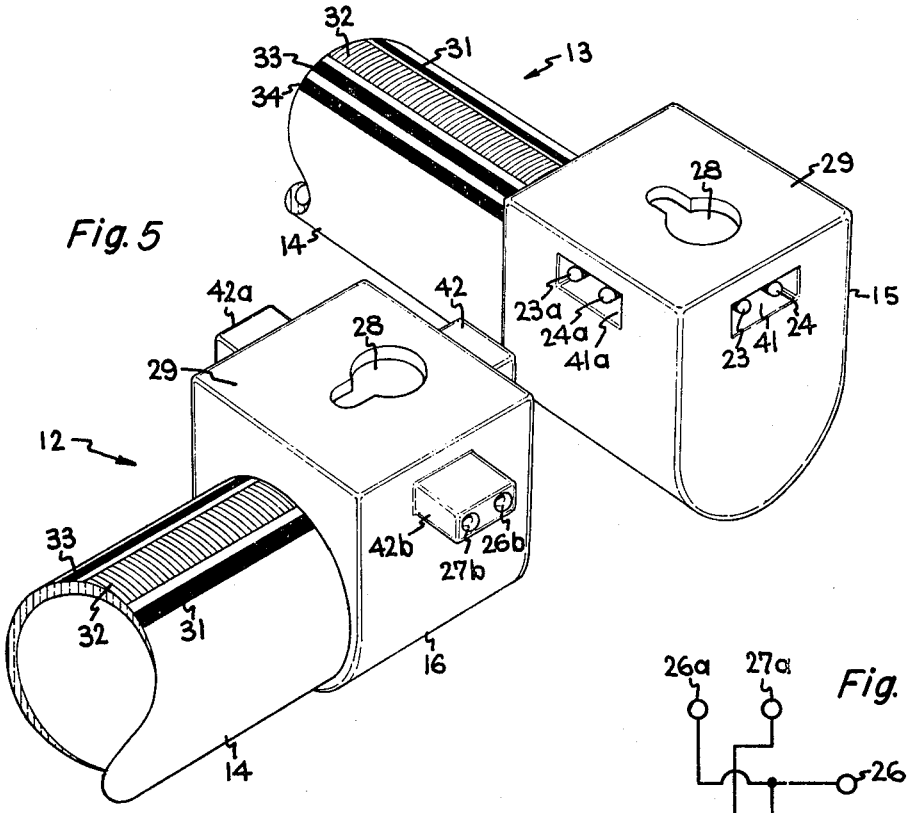
FIG. 5 is a perspective view of two lamps having end connectors in accordance with an alternative embodiment of the invention.
Figure 6:
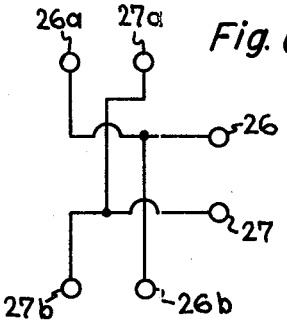
FIG. 6 is an electrical schematic diagram of circuit wiring in the end caps of FIG. 5.

In the modification of FIG. 5, the input power connector 15 is provided with a recess 41 for the terminals 23 and 24, as shown in FIG. 4, and the output power connector 16 is provided with a projection 42 for the receptacles 26 and 27, as shown in FIG. 4. The input power connector 15 also is provided with recesses **41*a* and 41*b* at the sides thereof, containing additional input power terminals, and the output power connector 16 is provided with additional projections 42*a* and 42*b* containing additional pairs of power receptacles. Thus, the two lamp units 12 and 13 can be connected together by plugging any of the projections 42, 42*a*, and 42*b* into any one of the recesses 41, 41*a*, or 41*b* of the lamp unit 13. This achieves the versatility of connecting the two lamps together in a straight line linear configuration, or at a right angle configuration with a side of the connector 15 against the end of the connector 16, or with a side of the connector 16 against the end of the connector 15. The electrical schematic diagram of FIG. 6 shows how the receptacles are wired in the connector 16 of lamp unit 12 in FIG. 5, the end receptacle 26 being electrically connected to the side receptacle 26*a* and the side receptacle 26*b*, and the end receptacle 27 being electrically connected to the side receptacles 27***a* and 27*b*. The end terminals 23 and 24 in the connector 15 of lamp unit 13 in FIG. 5 are similarly respectively electrically connected to the side terminals 23*a*, 23*b* and 24*a*, 24*b*.

The invention achieves its objectives of providing lamp units which are integral and permanently assembled units having compact and slender shapes and which can be connected together in a variety of configurations without the need for providing the customary heavy, clumsy, and space-consuming and expensive fixture member as has been required in prior art lamp units.

While preferred embodiments and modifications of the invention have been shown and described, various other embodiments and modifications thereof will become apparent to persons skilled in the art and will fall within the scope of the invention as defined in the following claims.

What I claim as new and desire to secure by Letters Patent of the U.S. is:

1. An integral lamp unit comprising an elongated gas discharge lamp containing first and second electrodes therein respectively near first and second ends thereof, an input power connector attached to said first end of the lamp and provided with first and second input power terminals, an output power connector attached to said second end of the lamp and provided with first and second output power terminals, a first elongated power conductor positioned alongside and adjacent to said lamp and connected electrically between said first input power terminal and said first output power terminal, a second elongated power conductor positioned alongside and adjacent to said lamp and connected electrically between said second input power terminal and said second output power terminal, ballast means connected electrically between said first input power terminal and said second electrode, and means electrically connecting said second input power terminal to said first electrode, said terminals of the input power connector being adapted to mate with the terminals of an output power connector of another similar lamp unit and said terminals of the output power connector being adapted to mate with the terminals of an input power connector of another similar lamp unit.

2. A lamp unit as claimed in claim 1, including a fuse connected in electrical series with one of said power conductors.

3. A lamp unit as claimed in claim 1, in which each of said power connectors is provided with mounting means at a side thereof and in alignment with each other along a line parallel to the axis of said lamp.

4. A lamp unit as claimed in claim 3, in which ach of said mounting means comprises a slot through a flat surface area of the respective power connectors.

5. A lamp unit as claimed in claim 1, in which said ballast means comprises an elongated ballast resistor positioned alongside and adjacent to said lamp, and in which said first and second power conductors and said ballast resistor are substantially parallel with each other and are substantially in alignment with said mounting means of the power connectors.

6. A lamp unit as claimed in claim 1, in which said first and second input power terminals are at the end of said input power connector and in which said first and second output power terminals are at the end of said output power connector.

7. A lamp unit as claimed in claim 6, in which said input power connector is provided with two additional pairs of input power terminals respectively at the sides thereof.

8. A lamp unit as claimed in claim 6, in which said output power connector is provided with two additional pairs of output power terminals respectively at the sides thereof.

9. A lamp unit as claimed in claim 1, in wich said input power connector is provided with a recess in the surface thereof, said input power terminals being positioned in said recess, and in which said output power connector is provided with a projection adapted to fit into said recess of another lamp, said output power terminals being positioned in said projection.

10. A lamp unit as claimed in claim 1, in which each of said first and second electrodes comprises a filament coated with electron-emitting material, said means connecting the second input power terminal to the first electrode being connected to a first end of said filament of the first electrode, said ballast means being connected to a first end of said filament of the second electrode, said lamp unit further comprising an elongated starting conductor positioned along-side and adjacent to said lamp, and a starting switch connected in electrical series combination with said starting conductor, and means connecting said series combination electrically between the remaining ends of said filaments.

11. A lamp unit as claimed in claim 10, in which said starting switch is positioned in one of said power connectors.

12. A lamp unit as claimed in claim 10, in which each of said power connectors is provided with mounting means at a side thereof and in alignment with each other along a line parallel to the axis of said lamp, in which said power conductors and said starting conductor are substantially parallel with each other and are substantially in alignment with said mounting means of the power connectors.

13. A lamp unit as claimed in claim 1, in which said power conductors are carried on said lamp.

14. A lamp unit as claimed in claim 1, in which said ballast means comprises a ballast resistor carried on said lamp.

15. A lamp unit as claimed in claim 14, in which said ballast resistor comprises a resistive material adhered directly to the surface of said lamp.

16. A lamp unit as claimed in claim 1, including a fuse interposed in the current path of one of said power conductors.

17. A lamp unit as claimed in claim 16, in which said fuse is designed to open-circuit at a current value substantially greater than the safe operating current of said lamp, said current value being a predetermined value of current that a given plurality of said lamps connected together would draw from a current source.

18. An integral lamp unit comprising an elongated gas discharge lamp containing first and second electrodes therein respectively near first and second ends thereof, an input power connector attached to said first end of the lamp and provided with first and second input power terminals, an output power connector attached to said second end of the lamp and provided with first and second output power terminals, a first elongated power conductor positioned alongside and adjacent to said lamp and connected electrically between said first input power terminal and said first output power terminal, a second elongated power conductor positioned alongside and adjacent to said lamp and connected electrically between said second input power terminal and said second output power terminal, ballast means connected electrically between said first input power terminal and said second electrode, and means electrically connecting said second input power terminal to said first electrode, said terminals of the output power connector being arranged in the form of a socket for connection thereto of input power terminals of another lamp unit.

19. A lamp unit as claimed in claim 18, in which said ballast means comprises an elongated ballast resistor positioned alongside and adjacent to said lamp.

20. A lamp unit as claimed in claim 18, in which each of said power connectors is provided with mounting means at a side thereof and in alignment with each other along a line parallel to the axis of said lamp.

21. A lamp unit as claimed in claim 18, including a fuse connected in electrical series with one of said power conductors.

22. An integral lamp unit comprising an elongated gas discharge lamp containing first and second electrodes therein respectively near first and second ends thereof, said integral lamp unit further comprising circuitry including ballast means and electrical connection means for connecting said circuitry to a source of electric power, and first and second end caps respectively attached to said first and second ends of the lamp, each of said first and second end caps being provided with substantially flat surface area mounting means at a side thereof and in alignment with each other along a line parallel to the axis of said lamp, said mounting means being independent from said electrical connection means.

23. A lamp unit as claimed in claim 22, in which each of said flat surface areas of the end caps is provided with a mounting opening therethrough.

* * * * *